United States Patent [19]

England

[11] Patent Number: 4,821,756

[45] Date of Patent: Apr. 18, 1989

[54] COLLAPSIBLE DIPOSABLE UMBRELLA

[75] Inventor: Daniel L. England, Irving, Tex.

[73] Assignee: Rainstix R & D Partners Ltd., Irving, Tex.

[21] Appl. No.: 168,250

[22] Filed: Mar. 15, 1988

[51] Int. Cl.[4] ..... A45B 19/00

[52] U.S. Cl. ..... 135/19.5; 135/20 R

[58] Field of Search ..... 135/19.5, 20 R

[56] References Cited

U.S. PATENT DOCUMENTS

| | | | |
|---|---|---|---|
| 1,547,538 | 7/1925 | Vincent | 135/19.5 X |
| 1,783,972 | 12/1930 | Moses | 135/19.5 X |
| 3,534,752 | 10/1970 | Vanzini | 135/20 R |
| 3,709,238 | 1/1973 | Leopoldi et al. | 135/20 R |
| 3,730,199 | 5/1973 | Thur | 135/20 R |
| 3,844,301 | 10/1974 | Harrell | 135/20 R |
| 4,084,600 | 4/1978 | dePolo | 135/20 R |
| 4,624,275 | 11/1986 | Baldwin | 135/19.5 |

FOREIGN PATENT DOCUMENTS

| | | | |
|---|---|---|---|
| 1288580 | 9/1972 | United Kingdom | 135/19.5 |

*Primary Examiner*—J. Karl Bell

*Attorney, Agent, or Firm*—John J. Byrne

[57] ABSTRACT

The invention is described toward a collapsible disposable umbrella formed from plastic, polyethylene and/or kraft paper components. The invention has a tubular container that serves as a handle when the umbrella is in use. The other components of the unit are stored within the container and when partially removed therefrom, an umbrella support structure expands and locks into position with a few simple movements.

15 Claims, 7 Drawing Sheets

FIG. 1
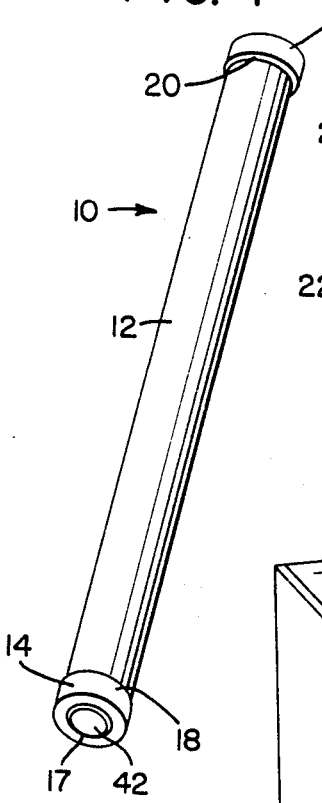
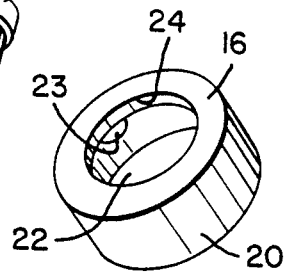
FIG. 1a
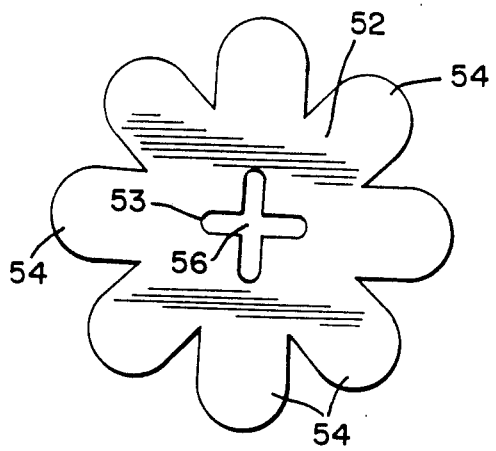
FIG. 10
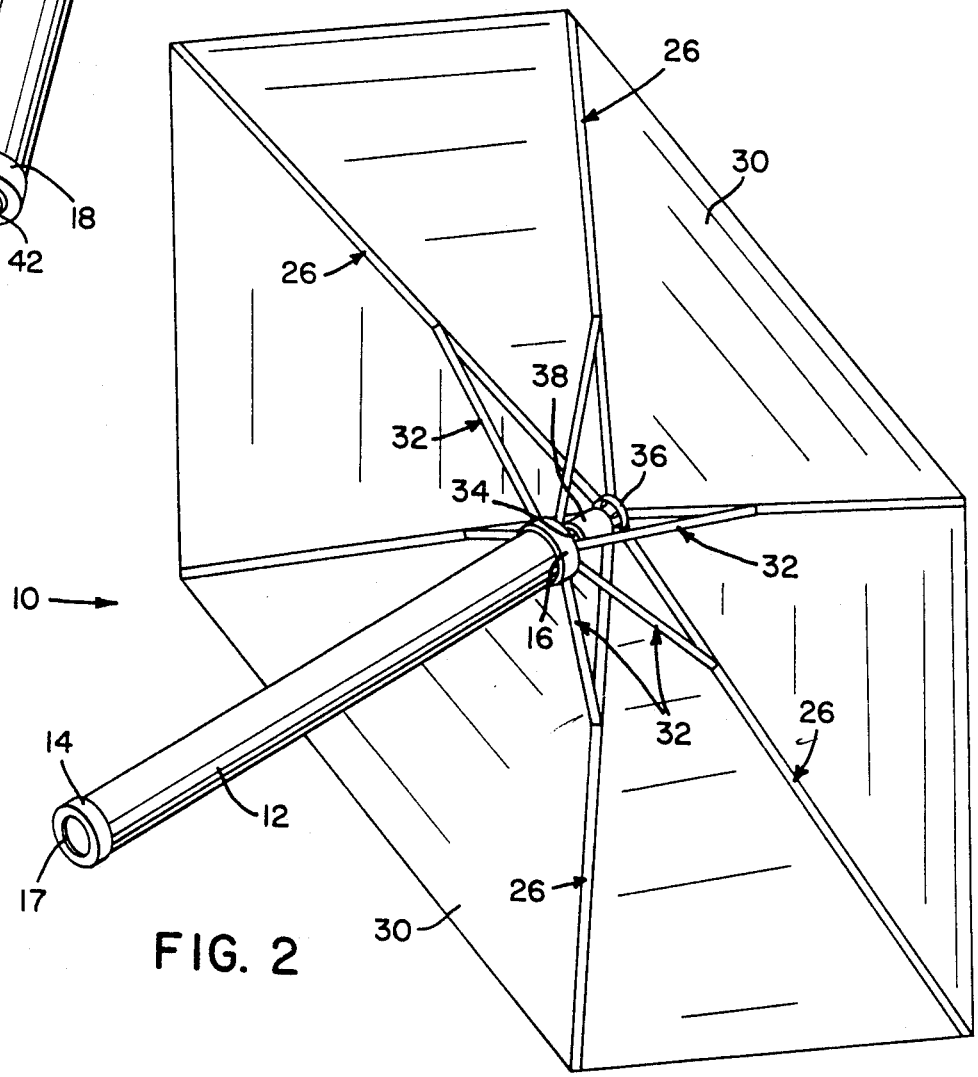
FIG. 2

COLLAPSIBLE DIPOSABLE UMBRELLA

TECHNICAL FIELD

This invention relates to a disposable umbrella and more particularly to a collapsible disposable umbrella manufactured from components that provide an inexpensive unit which is easily manufactured and assembled.

BACKGROUND OF THE INVENTION

The present invention provides an inexpensive collapsible disposable umbrella characterized by its simplicity of manufacture.

Conventional umbrellas normally require the mechanical assembly of many metal and plastic parts that are made to close mechanical and engineering tolerances. Because of this, conventional umbrellas can be costly and time consuming to manufacture. Moreover, many of the metal components of conventional umbrellas require special metal forming tools for manufacturing and costly time expenditures for assembly. The present invention is made entirely from inexpensive materials such as plastic or polyethylene which are easy to manufacture form and assemble.

Collapsible umbrellas disclosed by the prior art such as Epstein (U.S. Pat. No. 2,747,592) and Harrel (U.S. Pat. No. 3,844,301) include metallic parts and separately manufactured pieces that are snapped or wired together and have the plastic covering exposed to the elements. Such umbrellas are unnecessarily complicated by the addition of handle members which increase production costs.

SUMMARY OF THE INVENTION

The present invention is a collapsible disposable umbrella formed from plastic or other similar materials to provide an inexpensive and easily manufactured umbrella. The umbrella of the present invention is comprised basically of a cylindrical hollow tube and an inner shaft slidably disposed in the cylindrical hollow tube that carries the protective structure.

Additionally, first and second end caps cover the top and bottom of the tube protecting the mechanism of the invention from damage while stored. Furthermore, the hollow tube forms a convenient protective package utilizing a small amount of space as well as serving as a handle for the umbrella while it is in use.

After the inner shaft of the umbrella mechanism is extended to its full length, a centering ring snaps into a cylindrical groove in the top end of the hollow tube. This stabilizes the inner shaft in a central location so that the shaft can be telescoped back into the tube. This provides a sturdy handle mechanism for holding the umbrella when it is in use.

The hollow container tube precludes the requirement for manufacturing a conventional handle for the umbrella or a separate unit packaging.

The described embodiment of the present invention has the umbrella ribs and rib support struts provided with hooked ends for securing the ribs and rib support struts to top and bottom hubs, the latter being slidably received on the inner shaft.

Many of the components of the invention are made of inexpensive, light weight plastic or polyethylene which are formed by a single injection or extrusion. This, together with the ease of assembly, provides an inexpensive umbrella that can be considered disposable.

BRIEF DESCRIPTION OF THE DRAWINGS

A more complete understanding of the invention and its advantages will be apparent from the Detailed Description Of The Invention taken in conjunction with the accompanying drawings in which:

FIG. 1 is a perspective view of the umbrella in a collapsed, closed state;

FIG. 1*a* perspective view of a cap;

FIG. 2 is a perspective view of the umbrella in a deployed state;

FIG. 10 is a planar view of centering ring;

DETAILED DESCRIPTION OF THE PREFERRED EMBODIMENT

Figures 3A, 3B, 3C:
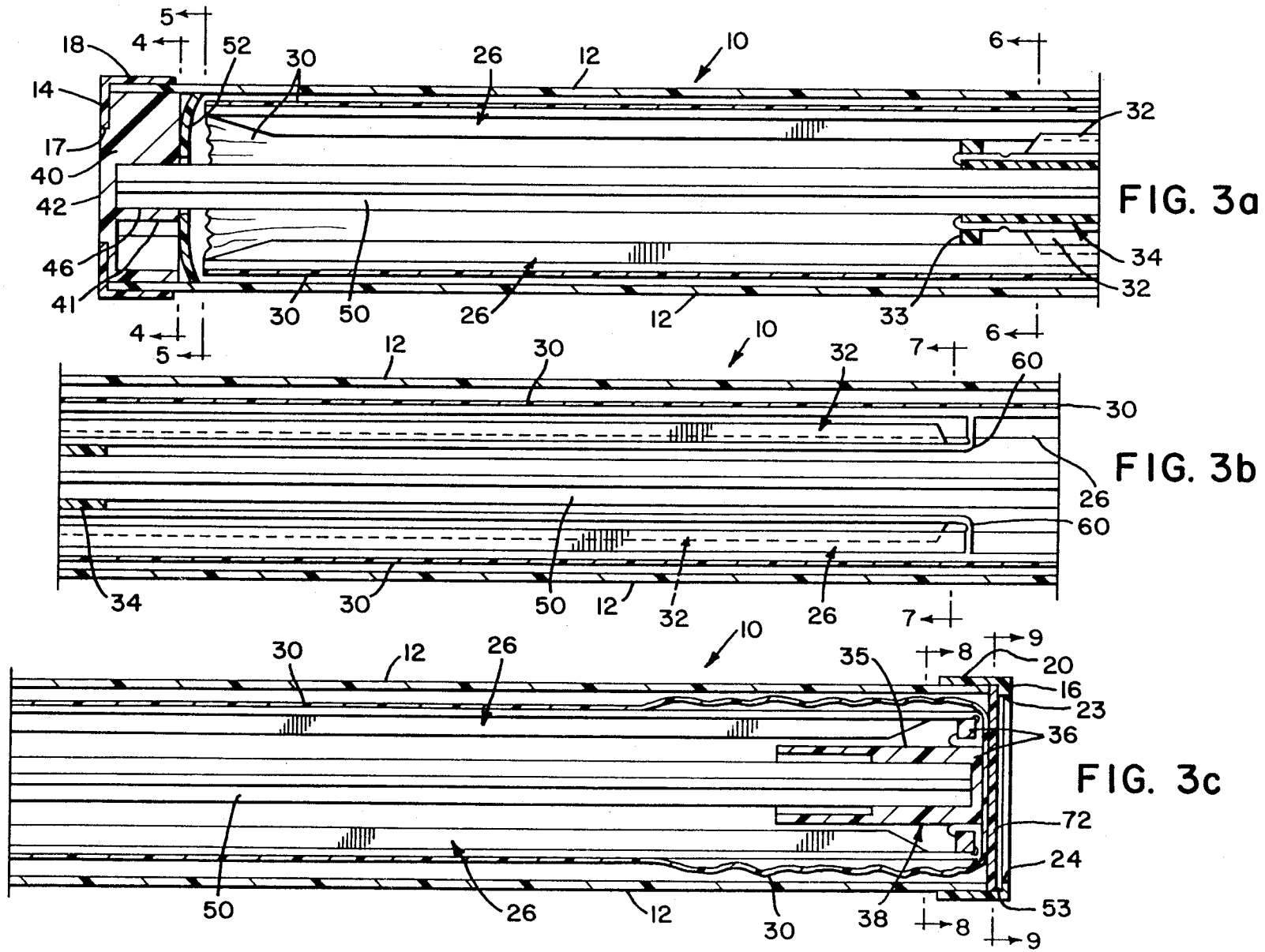
FIGS. 3*a*, 3*b* and 3 *c*, 3*d*, taken together, illustrate a longitudinal section view of the umbrella in its collapsed state.

Referring now to the drawings wherein like numerals indicate like parts, the numeral 10 indicates the umbrella of this invention. The unit includes a light plastic tubular container 12. A bottom end cap 14 is located at one end of the container and a top end cap 16 at the other end thereof. The bottom cap has an opening 17 and an upwardly extending skirt 18 that closely and snugly engages the lower end of tube 12. The upper cap 16 has a downwardly extending skirt 20 snugly engaging the upper end of tube 12 and an opening 22 defined by an inwardly directed ledge 24. Three bosses or nibs 23 are formed just beneath ledge 24. As seen in FIG. 2, the umbrella 10 further includes a plurality of ribs 26 having a plastic or protective sheet 30 secured to their upper surfaces. The sheet material 30 protects a user from the elements.

The ribs 26 are braced in their deployed, outwardly extending position by an equal number of struts 32 that have their outer ends hingedly secured approximately midway of the lengths of their respective ribs 26. The inner ends of the struts 32 are hingedly connected to the base 33 of a lower hub member 34. Extending upwardly from the base 33 of hub 34 is a hollow sleeve 35.

The inner ends of the ribs 26 are hingedly secured to the plate 36 of an upper hub member 38. The hinges and connections will be described in greater detail hereinafter.

A longitudinal cross section of the umbrella in its nested position can be seen in FIGS. *3a, 3b* and *3c*. At the lower end of the tube 10 is a piston 40, the main body of which has a peripheral surface that is the approximate dimension of the inner circumference of tube 12. A button 42 is formed in the bottom of surface of piston 40 and this button is received in opening 22. To make the piston 40 lighter, the piston is hollowed in several places throughout its periphery. Centrally of the piston 40 is an inner cylindrical wall 41 forming cavity 46 that receives the lower end of a shaft 50. The shaft has an X-shaped cross section and the corresponding cavity 46 is dimensioned so that the shaft 50 can be press-fitted therein. Disposed about the shaft 50 and above piston 40 is a centering ring 52. The centering ring is best seen in FIGS. *3a* and 10 and is comprised of a center section 53 having plurality of radially extending fingers 54. The centering ring is formed with an X-shaped opening 56 and is slidably received on shaft 50. The splines of shaft 50 are indicated by the numeral 51.

Figure 16:
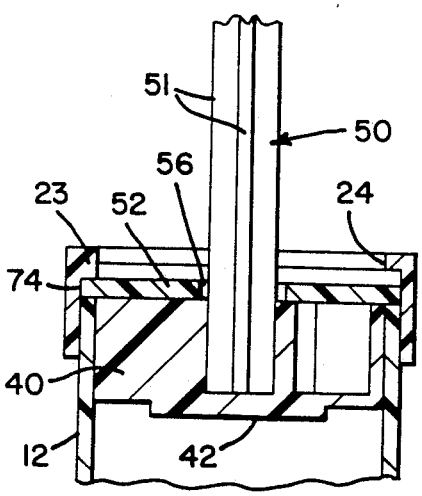
FIG. 16 is a cross-section of the upper tube after snap ring positioning.

The centering ring 52 has a diameter slightly greater than the interior diameter of the tube 12 and, when inserted within the tube, assumes a curved or saucer-shaped configuration as seen in FIG. *3a*. As will be seen later in this description, the disk or centering ring 52 moves upwardly with piston 40 and, since it is inherently flexible, it assumes a normal flat position when permitted to snap into an annular groove 74 formed between the upper end of tube 12 and ledge 24. See FIG. 16.

In the umbrella's nested or collapsed position, the outer ends of the ribs 26 are disposed near the bottom of the tube adjacent piston 40. At the top of FIG. *3a* it can be seen that lower hub member 34, to which the inner ends of struts 32 are snapped, is disposed intermediate of the length of tube 12. As seen in the cross section of FIG. *3b* and in FIG. 14, the outer ends of strut members 32 are hingedly secured to the ribs by living hinges 60 and to the hub 34 by living hinge 62. The living hinges are formed by an area of reduced cross section.

The upper hub member 38 is best seen in FIGS. *3c*, 17 and 19. The hub member includes a plate 36 having a downwardly extending bushing 66. The bushing is formed with a cavity 68 to receive the upper end of shaft 50. The bushing 34 is counterbored at 70 to receive the upwardly extending sleeve 35 of lower hub member 34.

Spaced above the upper hub member 38 when the umbrella is nested is a flexible retaining disk 72 (FIGS. *3c* and *3d*) which is maintained in position between the ledge 24 and the upper end of tube 12 by bosses 23. This disk can be of stiff kraft paper or the like. When the disk 72 is removed, an annular groove 74 is vacated that receives the outer edges of the fingers 54 of centering ring 52 when the umbrella is deployed.

Figure 13:
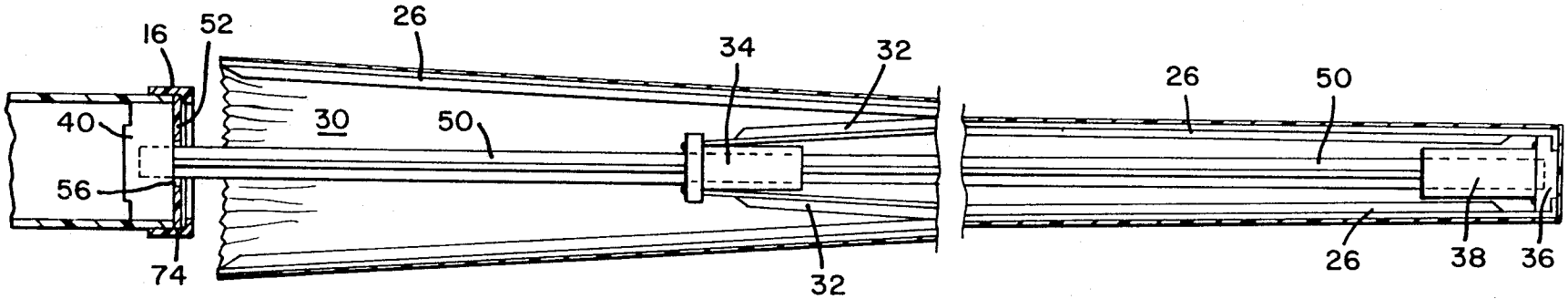
FIG. 13 is a partial longitudinal section view of the umbrella in a third partial deployment stage.

The position of the principal elements of the invention in certain stages of deployment can be seen with reference to FIGS. 11, 12, 13 and 14. Initially, the user presses the button 42 causing piston 40 and shaft 50 to move upwardly. This, in turn, causes the upper hub member to move through opening 22 and to dislodge disk 72. The upper hub member can then be grasped by the user and the working umbrella parts pulled outwardly from the tube until the lower ends of ribs 26 are clear of opening 22 as seen in FIG. 13. At this stage, centering ring 52 snaps into the annular groove 74 vacated by disk 72. The lower hub member 34 and the upper hub member 38 are moved toward one another until the upwardly extending sleeve 35 is press-fitted into the counterbore 70. Then, the shaft 50 and piston 40, with the hubs 34 and 38 now connected, are moved toward the bottom of the tube 12, and the umbrella assumes the deployed state as seen in FIG. 2. The centering ring 52 and cavity 46 provide a good degree of stability to the deployed unit.

Figure 17:
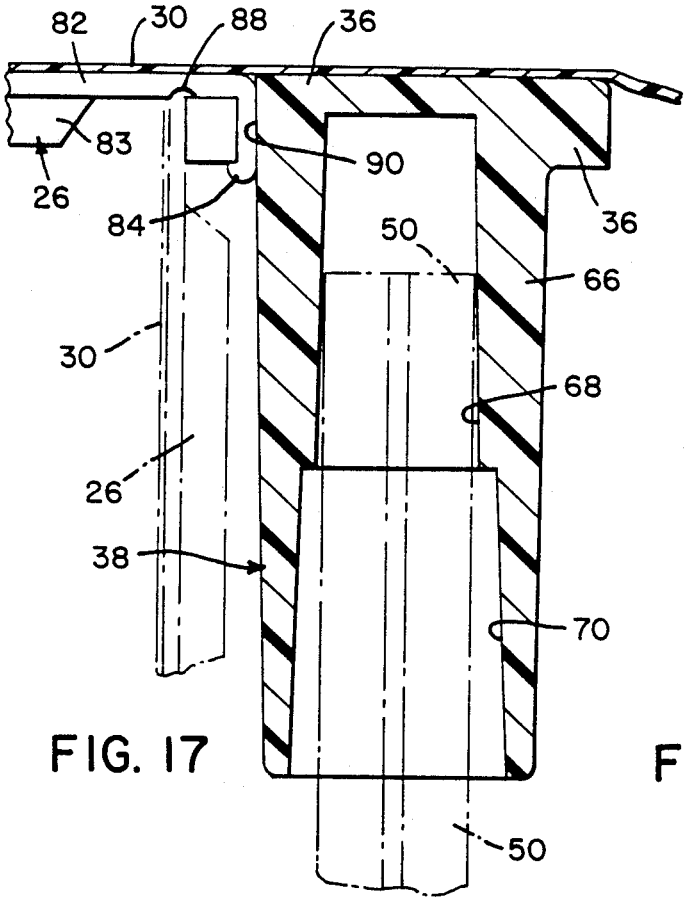
FIG. 17 is a side view of an upper hub showing an attached rib.
Figure 19:
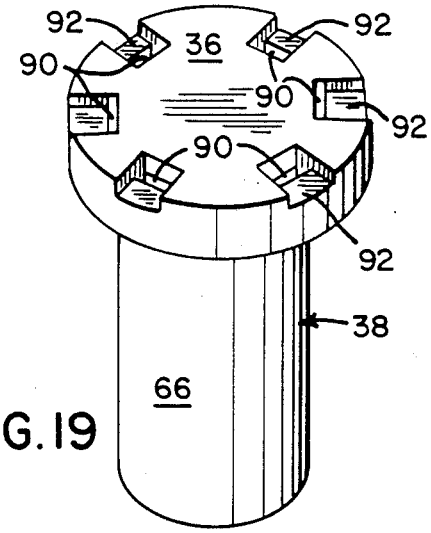
FIG. 19 is a perspective of the upper hub.
Figure 20:
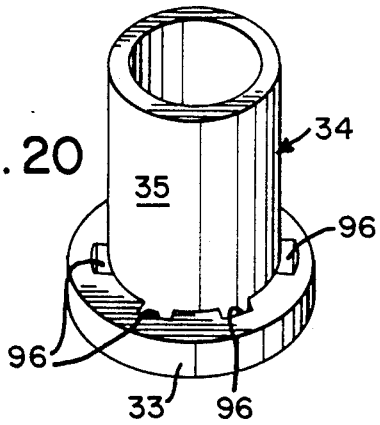
FIG. 20 is a perspective of the lower hub.
Figure 18:
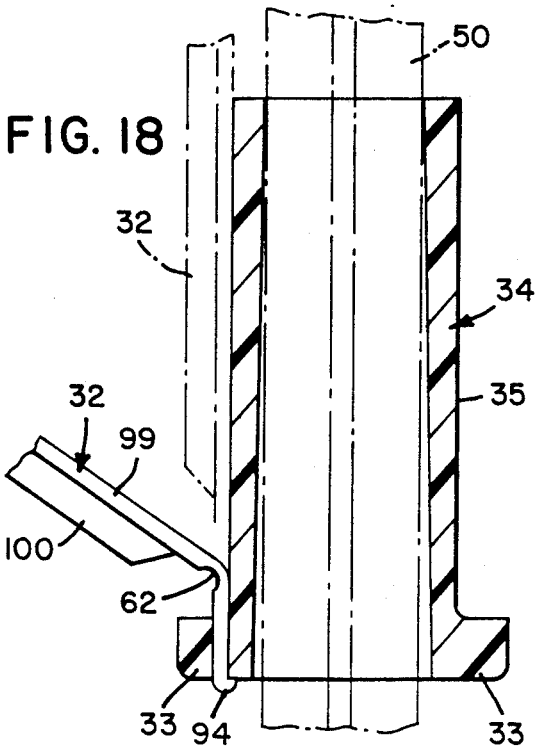
FIG. 18 is a side view of the upper hub showing an attached rib.
Figure 3D:
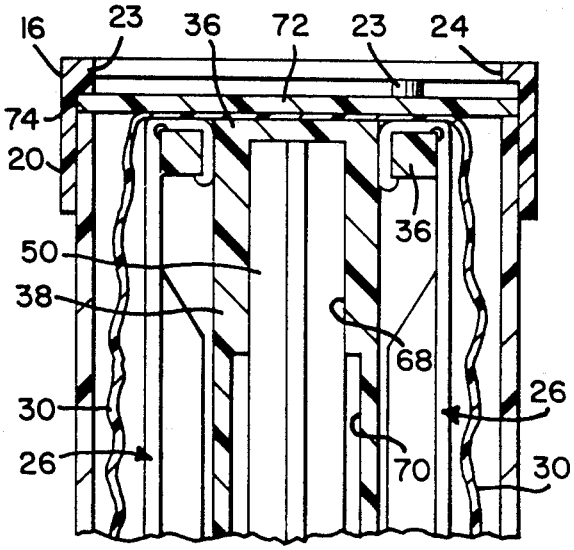
Figure 4:
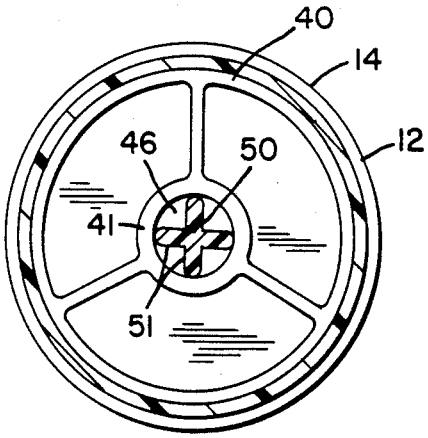
FIG. 4 cross section view of the umbrella taken along the lines 4—4 of the partial longitudinal section view depicted in FIG. 3*a;*
Figure 5:
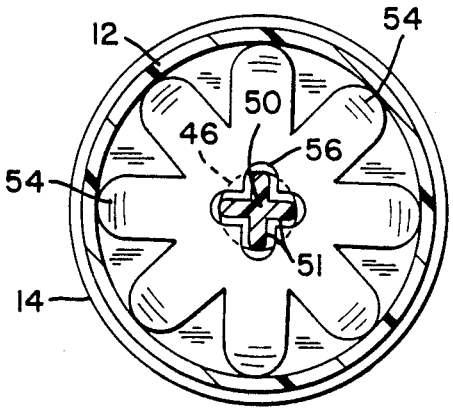
FIG. 5 is a cross section view of the umbrella taken along the lines 5—5 of the partial longitudinal section view depicted in FIG. 3*a;*
Figure 14:
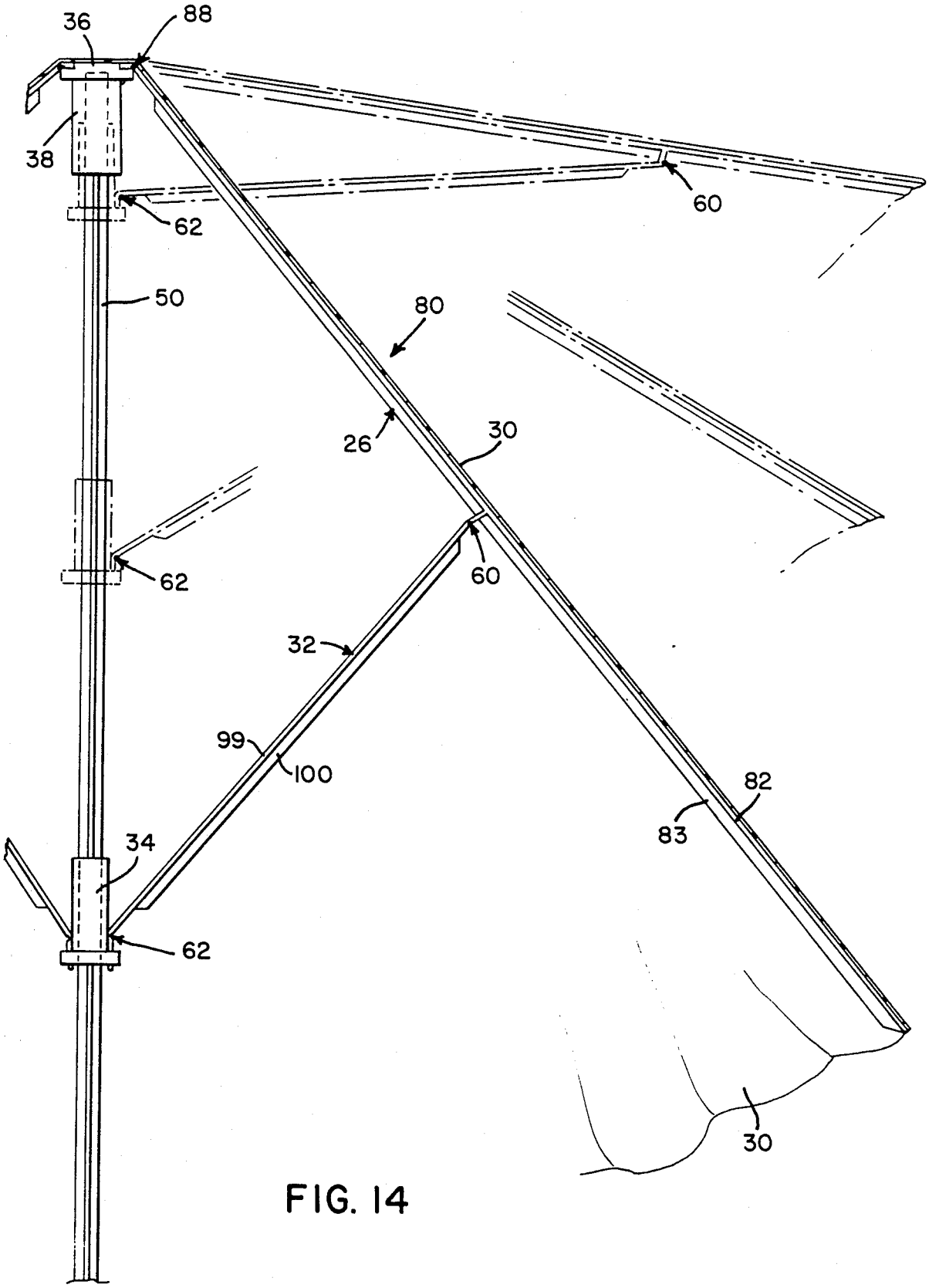
FIG. 14 is a partial longitudinal section view of the umbrella in a fourth deployment stage.

The combination strut and rib assembly 80 is best seen in FIG. 14. Each rib is formed with a planner section 82 and a stabilizer or reinforcing member 83. Inner hooks 84 are formed on the inner ends of each rib. Spaced a short distance from the hook 84 is an area of reduced cross-section that creates a living hinge 88. The upper hub member is formed with a plurality of apertures 90 in plate 36 and the plate is formed with radial grooves 92 leading thereto. As seen in FIG. 17, the hooks 84 are inserted into apertures 90 with the hook or retaining ledge in engagement with the under edge of plate 36. The hinge 88 permits the ribs to be bent downwardly parallel to the axis of the tube 12 for nesting within the tube. Each of the ribs 26 is assembled to the upper hub 38 in this manner.

Each strut 32 extends from a point intermediate the length of each rib 26. See FIG. 14. The struts 32 are formed by a planner member 99 and a stabilizer 100. At their distal ends, struts 32 are formed with hooks 94 which engage one of the apertures 96 in the base 33 of lower hub member 34. A living hinge is formed at 60. The living hinges units 60 and 88 permit the struts to assume a position generally parallel to the axis of tube 12, when nested, or a position angularly disposed with respect to the ribs and shaft so as to form a triangular support for the ribs 36 when the umbrella is in use. As can be seen in FIG. 2, triangles are formed by the inner portions of ribs 26, the struts 32 and the engaged lower and upper hub members 34 and 38.

Figure 6:
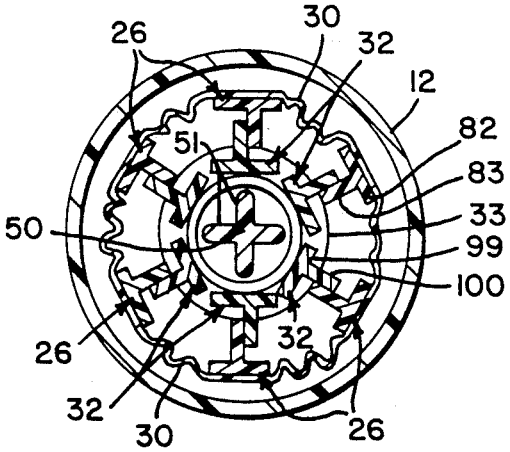
FIG. 6 is a cross section view of the umbrella taken along the lines 6—6 of the partial longitudinal section view depicted in FIG. 3*a;*
Figure 7:
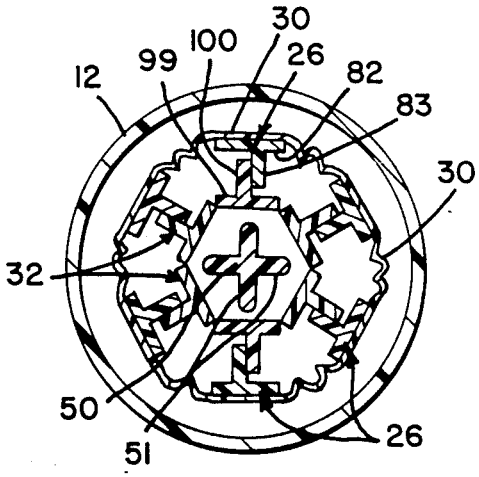
FIG. 7 is a cross section view of the umbrella taken along the lines 7—7 of the partial longitudinal section view depicted in FIG. 3*b;*

The rib members 26 are formed with reinforcing members 83. Each strut 32 is formed with a reinforcing member 100 that is perpendicular to its strut and slightly offset from the center thereof. Thus, when the umbrella is nested, a space saving is accomplished by nesting the reinforcing members 83 and 100 being in a side-by-side relationship as seen in FIGS. 6 and 7.

The tube 10 is light and easily stacked and stored for emergency use. A number of them can be kept by cab drivers, maitre d's, concierges, doormen and the like. If unexpected inclement weather is encountered, one of the disposable umbrellas can be given or sold to the using party. Also, the tube 12 and the material 30 can conveniently carry advertisements thereon.

Figure 15:
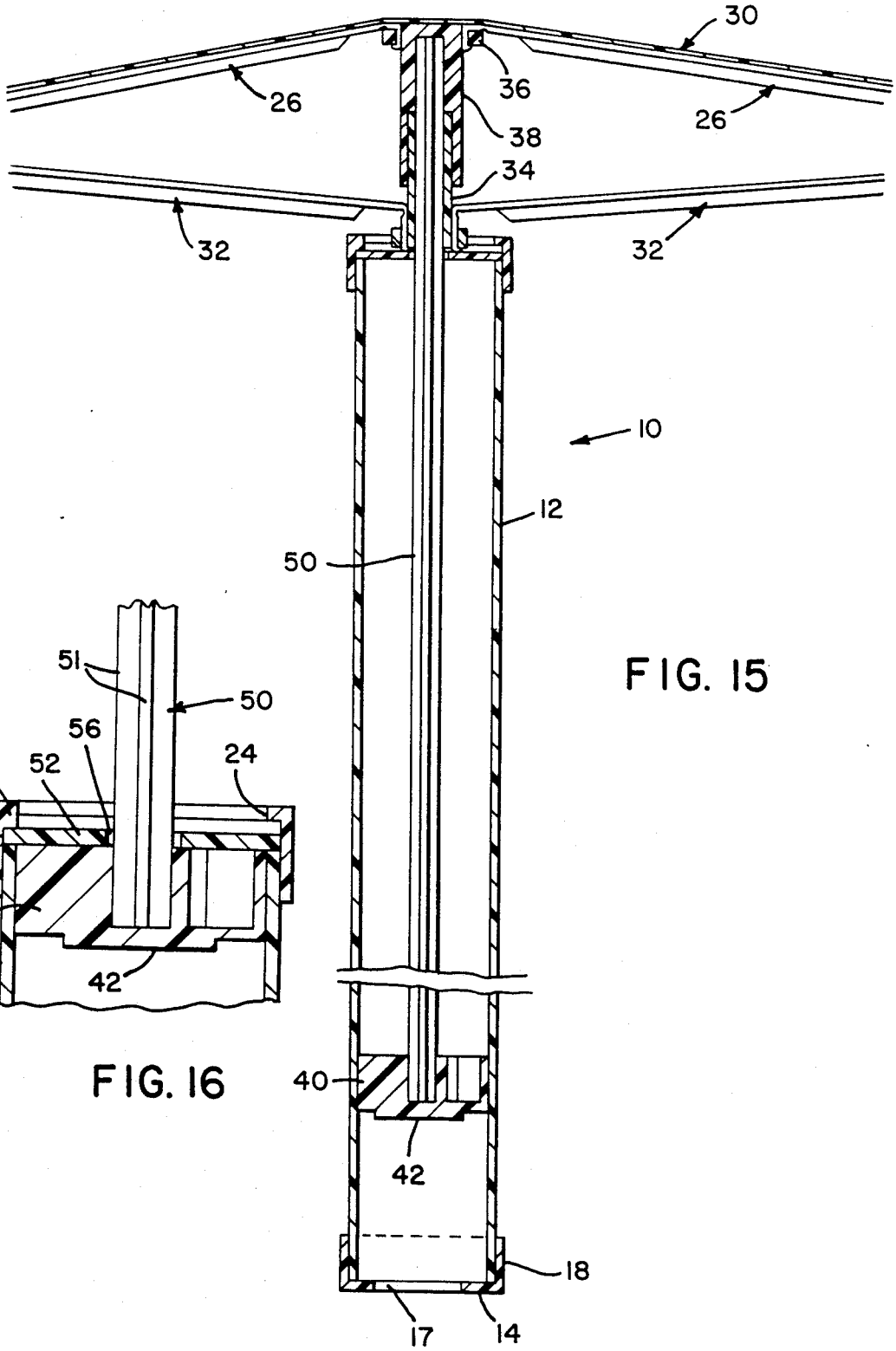
FIG. 15 is a partial longitudinal section view of the umbrella in its deployed stage.

The user must merely push button 42 so that the upper hub 38 dislodges cardboard disk 72. A sufficient amount of the hub is presented to the user so that the user can grasp same and pull the umbrella outwardly to the position shown in FIG. 13. At this stage, the outer edges of fingers 56 enter the groove 74. Lower hub 34 is then moved into engagement with the upper hub 38. When hubs 34 are in engagement, shaft 50 is lowered downwardly into tube 12 as seen in FIG. 15. The umbrella is then ready for use using the tube 12 as its handle.

Figure 8:
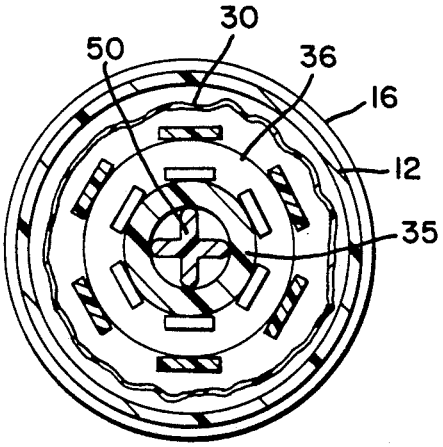
FIG. 8 is a cross section view of the umbrella taken along the lines 8—8 of the partial longitudinal section view depicted in FIG. 3*c;*
Figure 9:
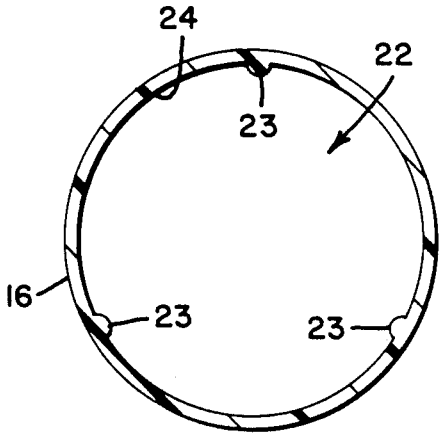
FIG. 9 is a cross section view of the umbrella taken along the lines 9—9 of the partial longitudinal section view depicted in FIG. 3*c;*
Figure 11:
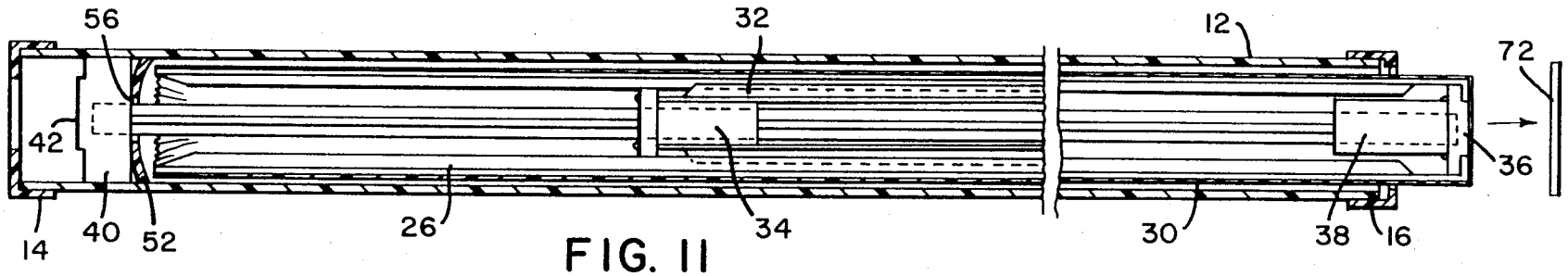
FIG. 11 is a partial longitudinal section view of the umbrella in a partial deployment stage.
Figure 12:
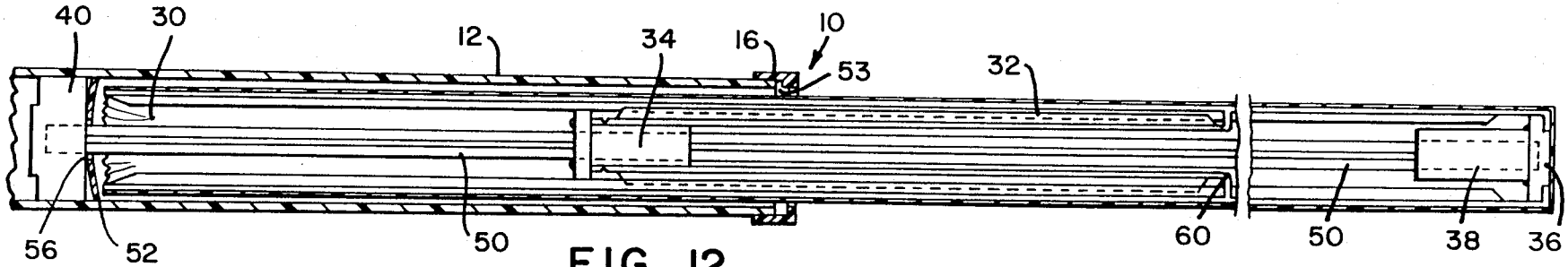
FIG. 12 is a partial longitudinal section view of the umbrella in a second partial deployment stage.

Note that material 30 is gathered together so that it can be housed within the tube 12 while the unit is nested. This is represented by wavy lines in FIGS. 6, 7 and 8. The material 30 is secured to the ribs 26 by glue or the like for most of the length of the ribs. However, as the material 30 approaches plate 36 of upper hub 38, it is free of the ribs so that the material will not be too stretched when the umbrella is in its fully deployed state.

Note in FIG. 14 that the ribbon-strut assembly 80 is cast as a single unit. The living hinges 60, 62 and 88, together with hooks 84 and 94, are formed at the same time the entire unit is molded. The lower and upper hubs, the shaft and other members can also be injection molded. The configuration of the hub members 34 and 38 enables an assembler to insert the hooks 84 into the openings 90 and the hooks 94 into openings 96 very quickly. No screws, retaining rings or other metallic items are necessary. When the units are assembled and the material 30 is secured to the ribs, the elements can assume the positions shown in FIGS. 3*a*, 3*b* and 3*c* 3*d* and inserted into the tube. The tube is then closed by inserting the disk 72.

Although a preferred embodiment of the invention has been illustrated in the accompanying drawings and described in the foregoing description, it will be understood that the invention is not limited to the embodiment disclosed, but is capable of modifications and substitutions of parts and elements without departing from the spirit of the invention.

I claim:

1. A collapsible umbrella comprising:

a hollow tube having an upper end and a lower end;

a shaft having a top end and a bottom end reciprocally received in said tube;

a piston secured to said bottom end and movable from said lower end of said tube to the upper end of said tube;

an upper hub fixedly secured to said top end;

a lower hub slidably received on said shaft and extending upwardly from said piston;

means to affix said upper hub to said lower hub;

a plurality of ribs hingedly connected to said upper hub and each rib having a first position parallel to the axis of said shaft and a second position extending radially outwardly from said shaft;

a plurality of bracing struts for each of said ribs, said struts having inner ends hingedly connected to said lower hub and outer ends hingedly connected to intermediate points on said ribs and said struts having first positions parallel to the axis of said shaft and second positions extending outwardly from said lower hub;

said second positions of said ribs and said struts occurring when said means affixes said upper hub to said lower hub.

2. The invention of claim 1 wherein the interior of said tube is sufficiently large to receive said ribs and said struts when both are in said first positions.

3. An umbrella comprising:

a shaft having an upper end and a lower end;

an upper hub member secured to said upper end;

a plurality of ribs;

hinge means securing said ribs to said hub for movement from a first position wherein said ribs are parallel to said shaft to a second position wherein said rib extend radially outwardly from said shaft;

a lower hub slidably received on said shaft and movable from a first position to a second position adjacent to said upper hub;

interengaging means to affix said upper hub to said lower hub when said lower hub is in said second position;

a bracing strut for each of said ribs, each of said struts extending between said hub and its respective rib;

second hinge means permitting movement of said struts from a first position where said struts are parallel to said shaft to a second position angularly disposed with respect to said shaft and said ribs;

said lower hub being in spaced relationship with said upper hub when said ribs and struts are in said first positions and said lower hub being in engagement with said upper hub when said ribs and struts are in their second positions;

a flexible sheet material secured to said ribs;

a tubular container for receiving said ribs and struts in their first positions and serving as a handle when said ribs and struts are in said second positions.

4. An umbrella comprising:

a tubular container having an upper end and a lower end and having an annular groove formed interiorally thereof adjacent said upper end;

a shaft received in said tube and having a top end, a bottom end and a length slightly less than that of said tube;

a piston;

means securing said piston to said bottom end of said shaft;

a flexible centering ring reciprocally received on said shaft, located above said piston and having a diameter greater than the diameter of said tube causing it to bow when located in said tube;

said shaft having a first position wherein said piston is at said lower end and said top end is below said grove and said shaft being movable to a second position wherein said shaft is substantially exterior of said tube and said centering ring is moved to a position coplanar with said groove and snaps therein;

a plurality of ribs;

a sheet of flexible protective material secured to said ribs;

first hinge means connecting said ribs to said top end for movement from a position parallel to said shaft to an expanded position extending radially outwardly from said shaft;

a lower hub member slidably received on said shaft;

a plurality of bracing struts, each one of which is associated with each of said ribs;

second hinge means connecting said braces to said hub and to each of said ribs for movement of said struts to a first position parallel to said shaft and to a second position wherein said struts are angularly disposed with respect to said ribs and said braces;

said tube having an interior sufficiently large to receive said shaft, said ribs, said struts and said material when said ribs and struts are in said second positions.

5. The device of claim 4 wherein a cap is secured above said upper end and said cap having an opening defined by an annular ledge that forms said annular groove with said upper end, said groove having a diameter as great as that of said centering ring.

6. The device of claim 4 wherein said top end of said shaft receives an upper hub member, said hub member in includes a plate centered over said shaft and a downwardly extending skirt defining a cavity receiving a portion of said shaft and said skirt having a counter bore in said cavity.

7. The device of claim 6 wherein said lower hub member has a ring to which said braces are secured, interengaging means securing said sleeve within said counter bore when said ribs and struts are in said second positions.

8. The device of claim 7 wherein said interengaging means is a taper on said counter bore that receives said sleeve as said upper and lower hubs are pushed toward one another.

9. The device of claim 4 wherein said tube is made of paper.

10. The device of claim 4 wherein said ribs and struts are integral with one another.

11. The device of claim 4 wherein said ring is formed with a plurality of spaced openings about its periphery and hook means formed on said struts engage said spaced openings.

12. The device of claim 6 wherein said plate is formed with a plurality of spaced openings about its periphery, second hook means formed on said ribs for engagement with said spaced opening in said plate.

13. The device of claim 4 wherein said first hinge means is formed by a reduced cross section in said ribs adjacent said top end.

14. The device of claim 4 wherein said second hinge means is formed by reduced cross sections in each of said struts at points near said ribs and near said lower hub.

15. The device of claim 5 wherein a paper disk is received in said annular groove when said shaft is in said first position and upward movement of said shaft dislodges said disk.

* * * * *